US005540295A

United States Patent [19]

Serrette

[11] Patent Number: 5,540,295

[45] Date of Patent: Jul. 30, 1996

[54] VIBRATOR FOR DRILL STEMS

[76] Inventor: Billy J. Serrette, 1043 Mustang Cir., St. Martinville, La. 70582

[21] Appl. No.: 410,854

[22] Filed: Mar. 27, 1995

[51] Int. Cl.[6] ..... E21B 7/24

[52] U.S. Cl. ..... 175/56; 173/49; 74/61

[58] Field of Search ..... 175/1, 55, 56; 74/61; 173/49

[56] References Cited

U.S. PATENT DOCUMENTS

| | | | |
|---|---|---|---|
| 54,144 | 4/1866 | Hamar . | |
| 701,992 | 6/1902 | Bowen . | |
| 711,506 | 10/1902 | Johnston . | |
| 774,071 | 11/1904 | Griffith . | |
| 777,351 | 12/1904 | Raymond . | |
| 845,120 | 2/1907 | Raymond . | |
| 848,395 | 3/1907 | Raymond . | |
| 1,017,743 | 2/1912 | Fitzgerald . | |
| 1,304,167 | 5/1919 | Dunham . | |
| 2,313,625 | 3/1943 | Cobi | 61/79 |
| 2,755,734 | 7/1956 | Smith | 102/22 |
| 3,075,424 | 1/1963 | McMackin et al. | 86/21 |
| 3,100,542 | 8/1963 | Stark | 175/1 |
| 3,106,258 | 10/1963 | Muller | 175/55 |
| 3,188,906 | 6/1965 | Beck | 86/20 |
| 3,199,399 | 8/1965 | Gardner | 86/20 |
| 3,242,999 | 3/1966 | Garner | 175/19 |
| 3,367,442 | 2/1968 | Setser . | |
| 3,394,766 | 7/1968 | LeBelle | 173/49 |
| 3,410,353 | 11/1968 | Martini | 173/73 |
| 3,430,719 | 3/1969 | White | 175/412 |
| 3,434,549 | 3/1969 | Lowe | 175/1 |
| 3,463,256 | 8/1969 | White | 175/412 |
| 3,590,738 | 7/1971 | Holzman | 102/21 |
| 3,702,635 | 11/1972 | Farr | 166/299 |
| 3,752,242 | 8/1973 | Gremillion | 175/108 |
| 3,768,576 | 10/1973 | Martini | 175/56 X |
| 3,804,182 | 4/1974 | Adair et al. | 175/1 |
| 3,833,071 | 9/1974 | Koosman et al. | 175/57 |
| 3,856,095 | 12/1974 | Adair et al. | 175/203 |
| 3,920,083 | 11/1975 | Makita | 173/49 |
| 3,939,771 | 2/1976 | McReynolds | 102/21.8 |
| 4,016,942 | 4/1977 | Wallis, Jr. et al. | 175/45 |
| 4,240,349 | 12/1980 | Lash | 102/24 R |
| 4,314,365 | 2/1982 | Petersen et al. | 175/56 X |
| 4,471,669 | 9/1984 | Seaberg | 74/687 |
| 4,553,443 | 11/1985 | Rossfelder et al. | 74/22 R |
| 4,667,750 | 5/1987 | Wise et al. | 175/55 |
| 4,819,740 | 4/1989 | Warrington | 173/49 |
| 4,921,057 | 5/1990 | Smet | 175/203 |
| 5,193,626 | 3/1993 | Jacob | 173/197 |
| 5,281,775 | 1/1994 | Gremillion | 181/116 |
| 5,382,760 | 1/1995 | Staron et al. | 175/1 X |

OTHER PUBLICATIONS

Eaton Corp. Catalog dated revision Aug. 1994, No. 11–878, for Char Lynn Disc Valve Hydraulic Motors.

Global Manufacturing, Inc. Catalog dated 1993, for Global Design Series Vibrators.

*Primary Examiner*—Frank S. Tsay

*Attorney, Agent, or Firm*—W. Thomas Timmons; Timmons & Kelly

[57] ABSTRACT

A vibrator yoke assembly (Y) for drill stems is moveably mounted on a drilling rig (R). A guide rail (10) is mounted to a support section (22) of the drill rig (R). Traveling along the guide rail (10) along the direction of travel for the drill string while boring the hole is a carriage (28) supporting the yoke assembly (Y). Activation of a motor moves the carriage (28) along the guide rail (10) as desired by the operator. Affixed to the carriage (28) above the upper end (12*u*) of the upper section (12) of the drill string (14) is the yoke assembly (Y). The yoke assembly (Y) has an upper hydraulic motor (40) coupled to an upper end (42) of a quill body (44). The quill body extends through the yoke assembly (Y) and a lower end (48) of the quill body engages the upper pipe end (12*u*). A pair of vibrators (52*a* and 52*b*) are attached to the yoke assembly (Y). Motors (58*a* and 58*b*) rotate eccentrics (60*a* and 60*b*), having flat segments or sections (62*a* and 62*b*), to cause the vibration in yoke assembly (Y) to assist in the boring of the hole.

18 Claims, 3 Drawing Sheets

VIBRATOR FOR DRILL STEMS

BACKGROUND OF THE INVENTION

1. Technical Field

The invention relates to seismic prospecting and geological exploration, and more particularly to a drilling rig having a vibrator systems affixed thereto that is used for forming holes in the earth using a pipe string.

2. Background Art

Land based seismic prospecting and geological exploration are well established arts. Generally, a movable drilling or exploration rig is assembled at a selected location where a hole is to be formed in the earth's crust. Typically, one or more sections of pipe, which form a drill string, with a drilling bit is used to rotary drill a hole in the ground or, alternatively, may be pushed into the earth either by a constant force in the desired direction or by a vibratory force applied on the upper exposed portion of the drill string.

Combining a vibratory system with other known types of apparatus for pile driving or earth boring, including such methods as rotary drilling or hammering, can improve the efficiency of the earth boring. The following U.S. patents relate generally to the use of vibratory systems in earth boring or pile driving:

U.S. Pat. No. 5,281,775;
U.S. Pat. No. 4,553,443;
U.S. Pat. No. 3,920,083;
U.S. Pat. No. 3,753,242;
U.S. Pat. No. 3,394,766; and,
U.S. Pat. No. 3,106,258.

U.S. Pat. No. 5,281,775 issued to Gremillion teaches a vibrating hole forming device for seismic exploration. A vertically mounted pipe is disclosed as having an attached rack gear cooperating with a hydraulically operated pinion to push the drill string into the ground forming the hole. At a predetermined pressure against further downward movement of the drill string, a vibrator is engaged. The vibratory motion is transmitted to the drill string at a point between the ends of the uppermost section of pipe, and thus not necessarily in a direction parallel to the longitudinal axis of the drill string.

U.S. Pat. No. 4,553,443, issued to Rossfelder, also discloses a vibrator system for earth boring. Similar to that as taught by Gremillion, the vibrator is attached to the pipe at a mid-position between the end placed in the ground and the upper end of the pipe.

U.S. Pat. No. 3,106,258 shows a vibratory pile driving device having the vibrator mechanism clamped to the top of the pile shaft being driven into the ground. The vibrations caused by the exciter are isolated from the supporting rig structure by means of compression springs.

It is therefore a feature of this invention to provide an improved hole forming device for earth boring.

It is a further feature of this invention a simplified drilling rig including a mechanical vibrator system to assist the pipe string in penetrating extremely dense subsurface features.

It is still a further feature of this invention that it can employ a hammer-type approach with varying frequencies to drilling includable with the known types of rotary drilling rigs.

DISCLOSURE OF INVENTION

The invention is a vibrator yoke assembly for drill stems or strings that is moveably mounted on a guide rail or mast of a drilling rig. The guide rail is mounted to a support section of the drill rig. Traveling along the guide rail along the direction of travel for the drill string while boring the hole is a carriage that supports the yoke assembly. Activation of a motor moves the carriage up and down along the guide rail as desired by the operator. Affixed to the carriage above the upper end of the upper section of the drill string is the yoke assembly. The yoke assembly includes an upper hydraulic motor coupled to an upper end of a quill body. The quill body extends through the yoke assembly and has a lower end of the quill body that engages the upper pipe end typically with a threaded joint.

A pair of vibrators are attached to the yoke assembly. Motors that preferably are constantly rotating at least at a low frequency turn eccentrics having flat segments or sections in the vibrators, thereby causing the vibration in yoke assembly. The vibration is then transmitted from the yoke assembly to the quill body attached to the drill string to assist in the boring of the hole when difficulty in penetrating a subsurface layer is encountered.

BRIEF DESCRIPTION OF DRAWING(S)

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
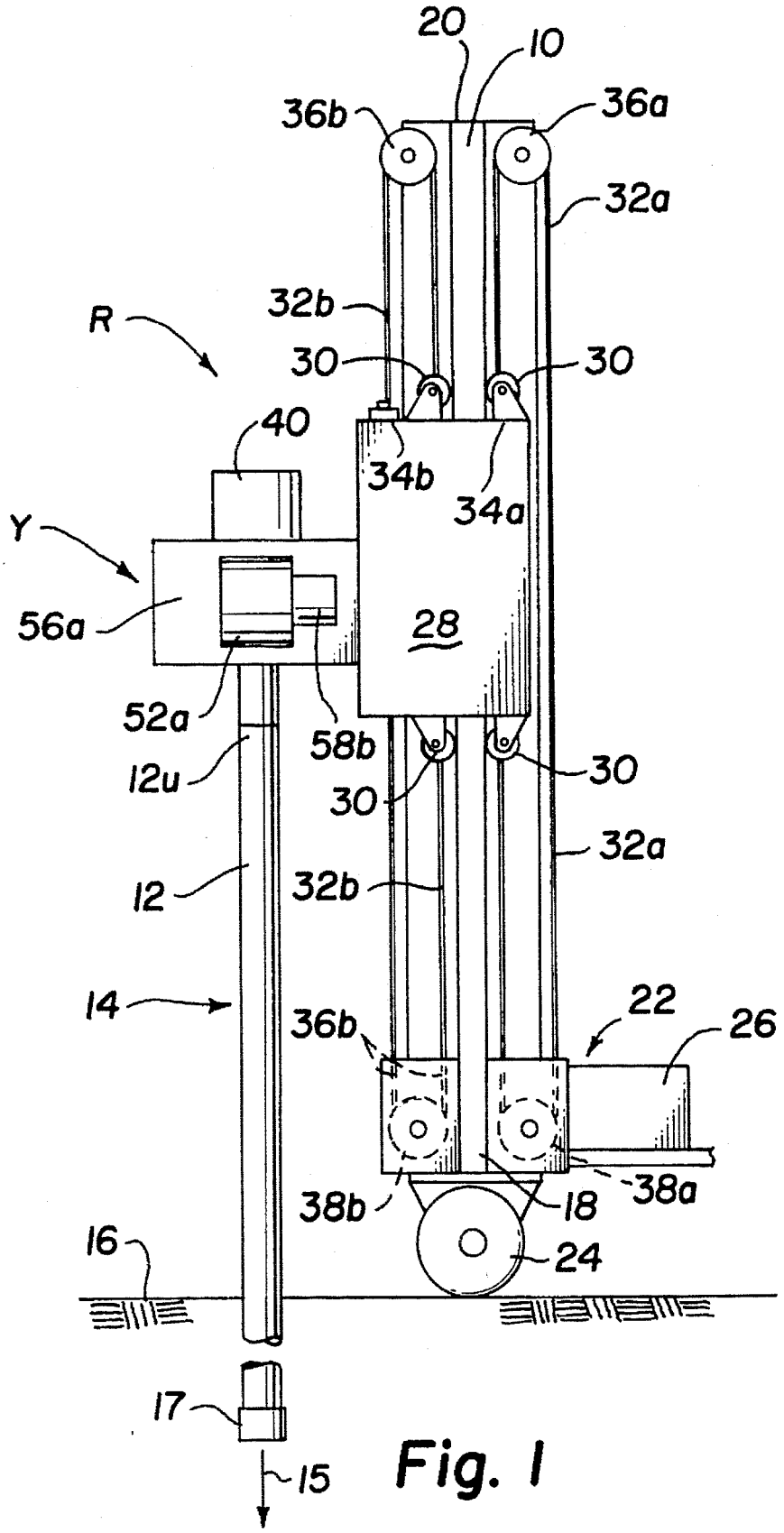
FIG. 1 is an elevational view of a hole boring apparatus of the present invention.

Referring now in general to FIG. 1, a vibrator yoke assembly Y for drill stems of the present invention is moveably mounted on a known drilling rig R. Drilling rig R typically includes a mast or guide rail 10. The guide rail 10, when assembled for drilling operations, is upright and substantially parallel to both the direction of drilling and the uppermost section of a pipe 12 in the drill or pipe string 14 used for boring the hole into the ground along a direction 15 corresponding to an axis along the length of the drill string 14. The drill string 14 is constructed from joining one or more sections or segments of the tubular pipe together to form a desired length corresponding to the approximate depth from the surface 16 of the earth or the length of the desired hole. The drill string is terminated at the lower end with a bit 17 selected by the operator of the rig in accordance with the drilling method and subsurface geological characteristics.

The guide rail or mast 10 has a lower end 18 and an upper end 20. The lower end of the guide rail 18 is mounted to the base or support section 22 of the drill rig R. In a movable rig, such as one that is mounted to the end of a truck 26, the support section 22 generally includes one or more wheels or tires 24 resting on the surface 16. Traveling along the guide rail 10 along the direction of travel for the drill string while boring the hole is a carriage 28 supporting the yoke assembly Y. The carriage 28 slides along the guide rail 10 assisted by a plurality of guide wheels 30 to reduce the friction. The length of the guide rail 10 should be longer than the length of a section of pipe 12 to permit the joining of the pipe sections to make the drill string 14 longer.

Cables 32*a* and 32*b* are attached at one end to the carriage 28 at mounts 34*a* (not shown) and 34*b*, respectively. The cables 32*a* and 32*b* extend upwardly from mounts 34*a* and 34*b* and loop about pulleys 36*a* and 36*b*, respectively, that are mounted to the guide rail 10 near upper end 20. The cables 32*a* and 32*b*, after being passed about the upper pulleys 36*a* and 36*b*, travel downwardly to motors or pulleys 38*a* and 38*b*, respectively. Controlled activation of a motor, such as 38*a* or 38*b*, would act as a winch to raise or lower the carriage 28 along the guide rail 10, as desired by the operator.

Figure 2:
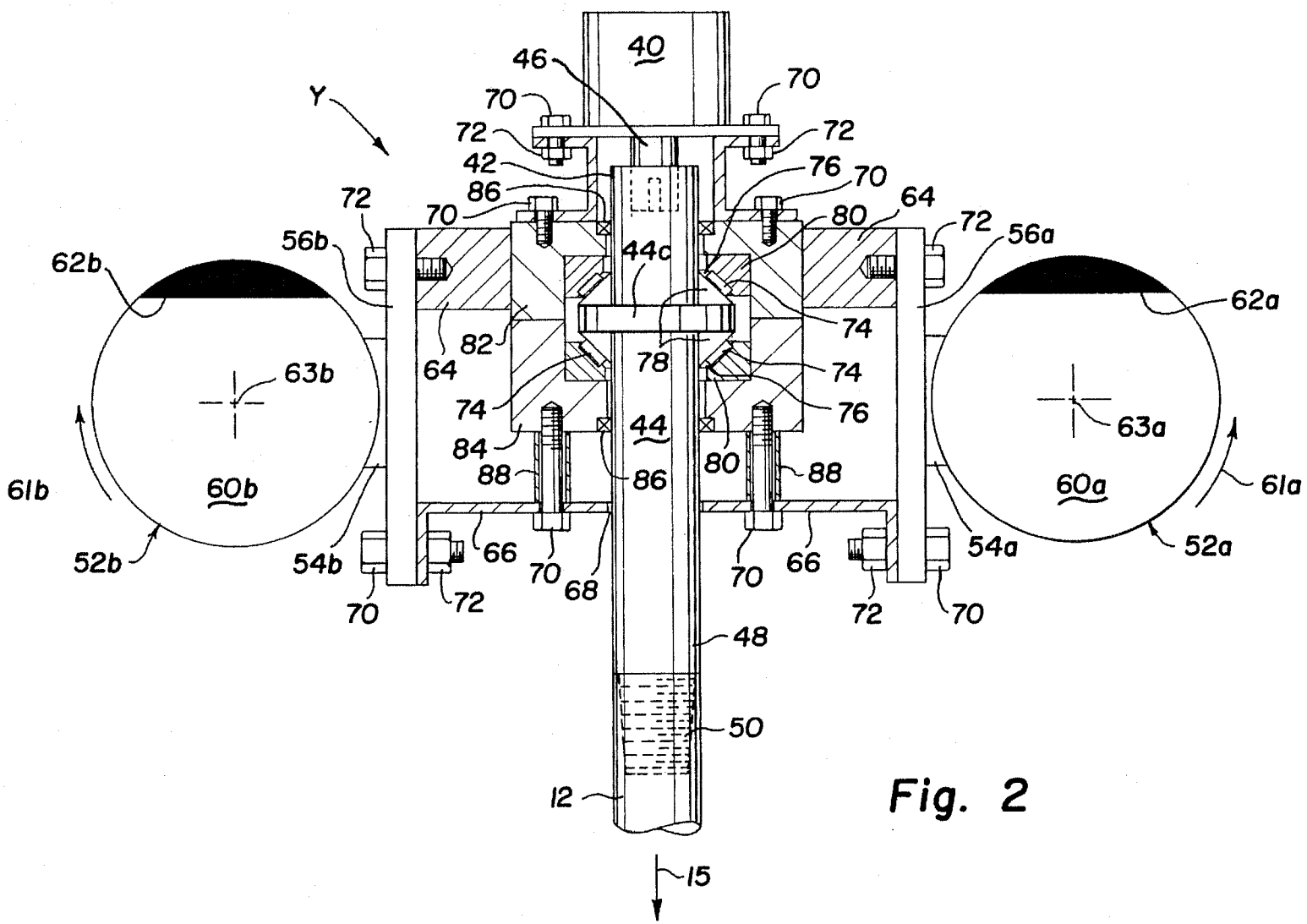
FIG. 2 is a sectional view of the operational components of the yoke assembly.

Affixed to the carriage 28 and positioned during operation of the present invention above the upper end 12*u* of the upper section 12 of the drill string 14 is the yoke assembly Y. Referring now in particular to FIG. 2, the yoke assembly Y comprises an upper hydraulic or other type of motor 40 that is coupled to an upper end 42 of a tubular quill body 44 by means of connection 46 between motor 40 and end 42. The quill body extends through the yoke assembly Y. The quill body 44 has a lower end 48 engaged or joined preferably by means of a thread 50 to the upper end 12*u* of the upper section of pipe 12.

A pair of a known type of hydraulic vibrator devices 52*a* and 52*b* are attached by means of joints 54*a* and 54*b*, respectively to sides 56*a* and 56*b* of the yoke assembly Y. Hydraulic or electrical motors 58*a* and 58*b* (not shown) controllably rotate eccentric masses 60*a* and 60*b*, which may have flat or other non-circular shaped segments or sections 62*a* and 62*b*, respectively, to cause the vibration in yoke assembly Y by vibrators 52*a* and 52*b* as the eccentric masses rotate. It is desired that the eccentrics rotate in opposite directions 61*a* and 61*b* to one another, and are synchronized such that the flat surfaces 62*a* and 62*b* are both at the tops of their rotational cycles at the same time. It is also desired that the eccentrics 60*a* and 60*b* rotate about an axis 63*a* and 63*b* that is essentially perpendicular to the vertical axis or the longitudinal axis 15 of the drill string. Most favorable is believed to have axes 63*a* and 63*b* parallel to one another and lying in a plane perpendicular to vertical axis 15. The synchronization optimizes the up and down movement of the yoke assembly Y, which further passes this force to the drill string through collar 44*c* affixed on the quill body 44, which in turn is secured to the upper section 12 of the drill string 14.

Upper plate 64 and lower plate 66 extend and connect sides 56*a* and 56*b*. A hole 68 is formed in lower plate 66 through which the quill body 44 passes. Upper plate 64, lower plate 66, and side plates 56*a* and 56*b* are secured together preferably by means of bolts 70 and complementary nuts 72 to permit easy disassembly for maintenance and repair.

The quill body 44 is formed having an annular collar 44*c* that cooperates with bearings 74 to restrain the quill body 44 from falling through the yoke assembly Y. Bearings 74 are themselves constrained to travel in an annular bearing race 76 that are concentric with the exterior of the tubular quill body 44. The an upper and lower bearing race 76 is each formed from a pair consisting of an inner annular ring 78 and complementary outer ring 80. The upper and lower bearing races 76 formed from the annular rings are secured between an upper bearing body 82 and lower bearing body 84 fixed between the upper plate 64 and bottom plate 66 by means of removable threaded bolts 70 and spacers 88, as needed. As with the bottom plate 66, the quill body 44 passes through the bearing bodies 82 and 84. One or more annular seals 86 mounted about the quill body 44 and the upper plate 64 and bottom plate 66 reduce the friction of the rotating quill body 44 and seal the bearings 74 and races 76 from pollutants or other unwanted debris.

Hydraulic Schematic

Figure 3:
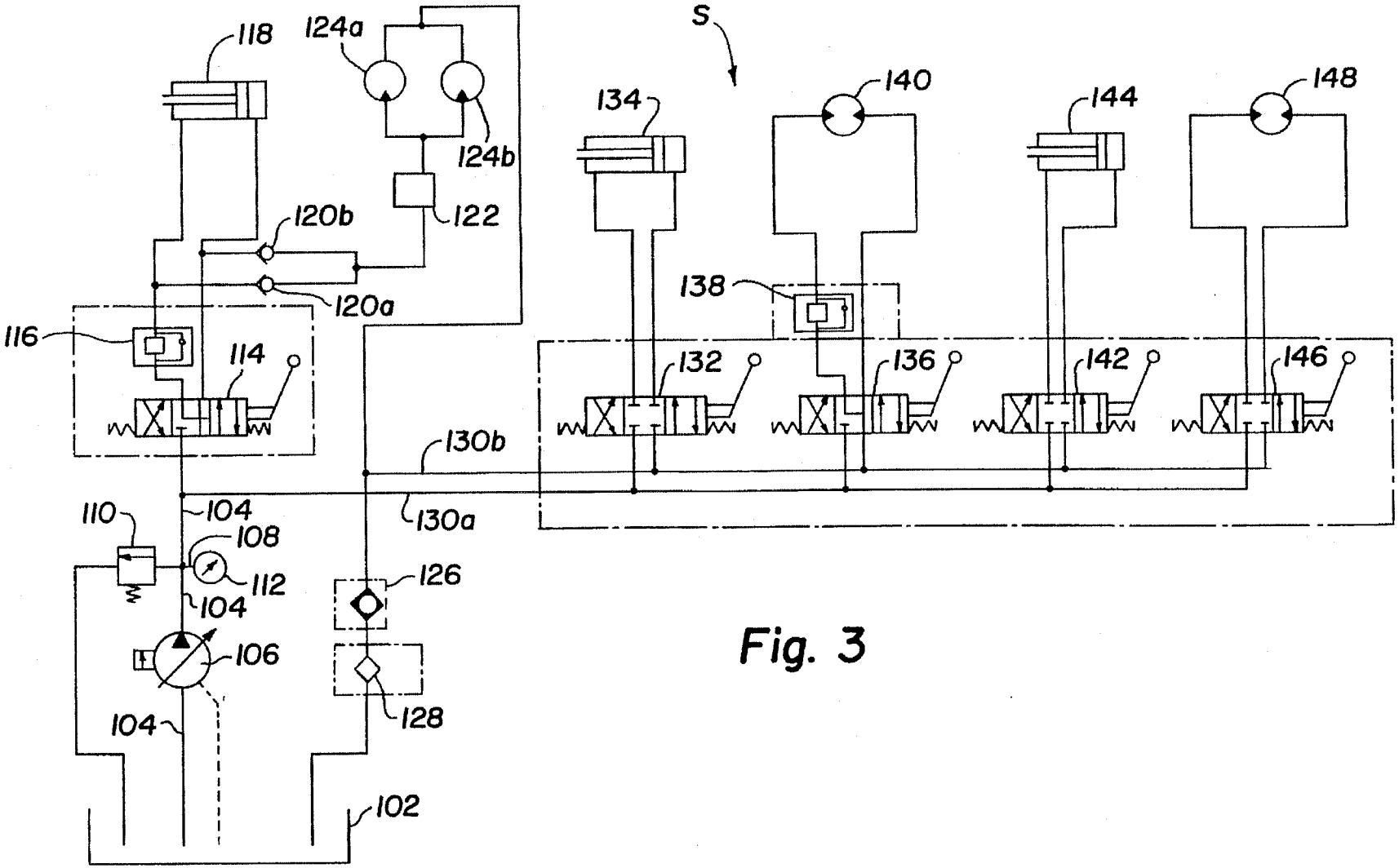
FIG. 3 is a schematic hydraulic flow diagram to activate the operational components.

Referring particularly to FIG. 3, a hydraulic schematic diagram is shown that may be used to operate and control the above describe components. Such diagram depicts the arrangement of main operative components of the present invention as they may be optionally powered by a system utilizing the transmission of hydraulic fluid.

Reservoir 102 provides a supply of hydraulic fluid or oil (not shown). The hydraulic fluid acts to transfer power from one component part to another in a known manner. The hydraulic fluid is conducted from one element or component to another by means of hydraulic line 104 through which the fluid flows. A pump or power supply 106 draws the hydraulic fluid from the reservoir 102 and forces the hydraulic fluid through the closed loop system S under pressure. Another hydraulic line 104 conducts the fluid from the pump 106 to a junction 108 as shown. A relief valve 110 and a pressure gauge 112 are hydraulically connected to junction 108. The relief valve 110 operates to control the fluid pressure in the system S by venting pressure from the system S when a desired pressure level is exceeded. The gauge 112 is a known hydraulic pressure measuring device.

The fluid flows from junction 108 to valve 114 and then generally to valve 116, which operate the main cylinder or ram 118 that drives the yoke assembly Y up and down the guide rail 10. Directional control valve 114 functions to operate or control the movement or the cylinder 118 in the up and down directional movement. Valve 116 is a known counter-balance valve to keep the ram 118 from drifting during certain operations of valve 114. For example, valve 116 operates to hold the cylinder 118 in a desired position when the directional control valve 114 is in a neutral position.

The main path for the hydraulic fluid also flows through check valves 120*a* and 120*b* that permit fluid flow therethrough only in a desired direction. From check valves 120*a* or 120*b*, the hydraulic fluid path goes to a flow control 122. The flow control 122 preferably cannot be shut-off or closed completely. From flow control 122, the hydraulic fluid travels through the hydraulic lines to at least one, and preferably two, vibrator assemblies 124*a* and 124*b*. Vibrators 124*a* and 124*b* are known hydraulically powered motors 58*a* and 58*b* and vibrators 52*a* and 52*b* (see FIG. 1).

From the vibrator assemblies 124*a* and 124*b*, the hydraulic fluid flows generally through a known heat exchanger 126 to a return filter 128 and thence to return to the reservoir 102. The heat exchanger 126 assists in maintaining the hydraulic fluid at a desired temperature. The return filter 128 removes undesired pollutants from the hydraulic stream or path.

FIG. 3 also shows an optional extension or addition to the above hydraulic main path or circuit. Branches 130*a* and 130*b* transmit the hydraulic fluid from the main section of the hydraulic circuit to a collection of additional motors and cylinders that provide other selected functions to the drilling rig of the present invention R.

A directional valve 132 controllably passes the hydraulic fluid to a cylinder or ram 134. Such a cylinder 134 may optionally control the gross movement in the raising or lowering of the yoke assembly Y along the guide rail or mast 10. Branches 130*a* and 130*b* may also extend to another directional type valve 136. Valve 136 is hydraulically connected to another counter balance valve 138 that controls the fluid flow to hydraulic motor 140. Motor 140 may by choice be bi-directional and used to control a winch (not shown). The valve 138 acts similarly to valve 116 to maintain the desired fluid flow characteristics through the motor 140.

Likewise, directional valve 142 controls the fluid flow through another cylinder or ram 144 that can function to activate a clamp to restrain the drill string. As a final example of the optional extension to the main hydraulic circuit, directional valve 146 passes the fluid flow through motor 148. Motor 148 can be used to power a rotary means to screw or unscrew the sections of pipe in the drill string together.

While the above explanation of FIG. 3 utilizes a hydraulic or fluid powered circuit, the present invention can alternatively be controlled by electrical circuit or other means as desired. The choice of control design should include consideration for the operational environment of the present invention in that the present invention may be used in areas subject to explosive gas accumulation.

Operation

In operation of the drilling rig of the present invention R, the rig R is positioned above or near where the hole is to be bored in the earth. The carriage 28 is moved to its uppermost position on the guide rail 10. The first pipe section is connected to the threaded coupling 50 with the assistance of motor 40 turning the quill body 44. When the pipe string is joined, the carriage 28 is lowered until the drilling end of the first section of the pipe contacts the ground at the selected location of the boring operation. The carriage is the further lowered in one embodiment with the weight of the carriage 44 and yoke assembly Y pushing the drill string into the ground.

Upon the drill string encountering an impenetrable subsurface layer, the motors 58*a* and 58*b*, which preferably are heretofore turning or rotating the vibrators 52*a* and 52*b* at a low speed or frequency, are speeded-up to increase the frequency of the vibrations on the top of the drill string.

The rotation of the eccentrics 60*a* and 60*b* are controllably synchronized such that the flat sections 62*a* and 62*b* are both at the top at the same point. It is also preferred that the eccentrics rotate in opposite directions 61*a* and 61*b* about an axis 63*a* and 63*b* that is essentially perpendicular to the vertical axis or the longitudinal axis 15 of the drill string. The synchronization optimizes the up and down movement of the yoke assembly Y, which further passes this force to the drill string through collar 44*c* affixed on the quill body 44, which in turn is secured to the upper section 12 of the drill string 14.

The combination of the force from the weight of the carriage 28 with the cyclical force of the vibrations of the yoke assembly Y increases the penetrability of the drill string.

When the carriage 28 pushes substantially all of the upper section 12 of the drill string into the ground 16, it is likely that the carriage 28 would be at the lower portion of the guide rail 10. At this point the quill body 44 may then be rotated in the opposite direction to unscrew the thread 50 from the upper end 12*u* of the pipe. The carriage would then be raised, possibly by winching the carriage up with cables 32*a* and 32*b*. Another section of pipe could then be inserted between the pipe segment located in the ground and the quill body 44. The quill body 44 would be threaded onto the top of the new pipe section and the lower end of the new pipe section would be threaded or otherwise joined to the upper end of the pipe segment extending out of the ground.

By repetition of this cycle, it is possible to construct a drill string of a desired length and consequently to bore a hole as deep as wanted.

Alternatively, the drilling rig can utilize a rotary drill bit and rotary drilling method. The vibrating yoke assembly Y would be used to assist in this method of drilling in a completely similar way.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. An earth boring apparatus using at least an upper section of drill pipe forming a drill string for boring geophysical holes to a desired depth, the apparatus comprising:

an upright guide rail extending from a support base means for maintaining the apparatus at a selected location for boring the hole and securing said guide rail in a position above the location of the hole and substantially parallel to the drill string;

a carriage means movably coupled to said guide rail;

a yoke assembly attached to said carriage for securing an upper end of the upper section of the drill string; said yoke assembly includes a plurality of vibrating means for generating in the yoke assembly cyclically recurring forces at selected frequencies substantially in the longitudinal direction of the drill string; said yoke assembly transmits the recurring vibratory forces to the drill string; and, main drilling means for providing a normal motive force that is substantially constant on the drill string to cause the drill string to penetrate in a boring manner through the earth until reaching the selected depth for the bore hole; said main drilling means acting directly only on the upper end of the upper section of the drill string, whereby the main drilling means is principally used to cause the drill string to bore the desired hole and when the drill string reaches an impenetrable subsurface layer, the frequency of the vibrators is increased to assist in the penetration of the drill string.

2. The apparatus of claim 1, wherein two vibrators each have a rotating eccentric mass that rotate in a synchronized cycle.

3. The apparatus of claim 2, wherein said two eccentric masses rotate through their cycles in opposite directions.

4. The apparatus of claim 2, wherein said eccentric masses rotate about an axis perpendicular to a longitudinal axis of the drill string.

5. The apparatus of claim 1, wherein the vibrators are actuated by a hydraulic fluid circuit.

6. The apparatus of claim 1, wherein the main drilling means includes a downward force in the direction of boring, which force is applied through said yoke assembly being pushed against the upper end of the upper pipe section by means of a motor forcing said carriage along said guide rail in the direction of the applied downward force.

7. The apparatus of claim 1, wherein the main drilling means includes a motor means for causing rotation in the drill string about a longitudinal axis.

8. The apparatus of claim 1, wherein the yoke assembly includes:

a tubular quill body formed having an annular collar; said quill body extending through a housing for joining with an upper end of a pipe section; said housing secures a bearing assembly to permit rotation of said quill body about an vertical axis of the drill string and to restrain said quill body against undesired movement in a direction along said vertical axis;

a motor coupled to an upper end of said quill body for controllably rotating said quill body about the vertical axis; and, coupling means formed with a lower end of said quill body for rigidly joining said quill body to the upper end of the upper section of the drill string.

9. The apparatus of claim 1, wherein the upright guide rail is longer than a length of the pipe section.

10. An earth boring apparatus, using at least an upper section of drill pipe forming a drill string for boring geophysical holes to a desired depth, of the type that includes an upright guide rail extending from a support base means for maintaining the apparatus at a selected location for boring the hole and securing said guide rail in a position above the location of the hole and substantially parallel to the drill string, a carriage means movably coupled to said guide rail, and a yoke assembly attached to said carriage for securing an upper end of the upper section of the drill string, the improvement comprising:

the yoke assembly includes a plurality of vibrating means for generating in the yoke assembly cyclically recurring forces at selected frequencies substantially in the longitudinal direction of the drill string; said yoke assembly transmits the recurring vibratory forces to the drill string; and, main drilling means for providing a normal motive force that is substantially constant on the drill string to cause the drill string to penetrate in a boring manner through the earth until reaching the selected depth for the bore hole; said main drilling means acting only on the upper end of the upper section of the drill string, whereby the main drilling means is principally used to cause the drill string to bore the desired hole and when the drill string reaches an impenetrable subsurface layer, the frequency of the vibrators is increased to assist in the penetration of the drill string.

11. The apparatus of claim 10, wherein two vibrators each have a rotating eccentric mass that rotate in a synchronized cycle.

12. The apparatus of claim 11, wherein said two eccentric masses rotate through their cycles in opposite directions.

13. The apparatus of claim 11, wherein said eccentric masses rotate about an axis perpendicular to a longitudinal axis of the drill string.

14. The apparatus of claim 10, wherein the vibrators are actuated by a hydraulic fluid circuit.

15. The apparatus of claim 10, wherein the main drilling means includes a downward force in the direction of boring, which force is applied through said yoke assembly being pushed against the upper end of the upper pipe section by means of a motor forcing said carriage along said guide rail in the direction of the applied downward force.

16. The apparatus of claim 10, wherein the main drilling means includes a motor means for causing rotation in the drill string about a longitudinal axis.

17. The apparatus of claim 10, wherein the yoke assembly includes:

a tubular quill body formed having an annular collar; said quill body extending through a housing for joining with an upper end of a pipe section; said housing securing a bearing assembly to permit rotation of said quill body about an vertical axis and to restrain said quill body against undesired movement in a direction along said vertical axis;

a motor coupled to an upper end of said quill body for controllably rotating said quill body about the vertical axis; and, coupling means formed with a lower end of said quill body for rigidly joining said quill body to the upper end of the upper section of the drill string.

18. The apparatus of claim 10, wherein the upright guide rail is longer than a length of the pipe section.

* * * * *